United States Patent [19]

Hildebrand et al.

[11] 4,110,192

[45] Aug. 29, 1978

[54] PROCESS FOR LIQUEFYING COAL EMPLOYING A VENTED DISSOLVER

[75] Inventors: Richard Emil Hildebrand, Glenshaw; John Angelo Paraskos; Herman Taylor, Jr., both of Pittsburgh, all of Pa.

[73] Assignee: Gulf Research & Development Company, Pittsburgh, Pa.

[21] Appl. No.: 746,181

[22] Filed: Nov. 30, 1976

[51] Int. Cl.[2] ..... C10G 1/04

[52] U.S. Cl. ..... 208/8; 208/10

[58] Field of Search ..... 208/10, 8

[56] References Cited

U.S. PATENT DOCUMENTS

| | | | |
|---|---|---|---|
| 3,692,662 | 9/1972 | Wilson et al. | 208/8 |
| 3,856,658 | 12/1974 | Wolk et al. | 208/10 |
| 3,884,795 | 5/1975 | Wright et al. | 208/8 |
| 3,932,266 | 1/1976 | Sze et al. | 208/10 |

*Primary Examiner*—Delbert E. Gantz
*Assistant Examiner*—Joan Thierstein

[57] ABSTRACT

A process for liquefying coal employing a low temperature preheater zone, a higher temperature non-catalytic hydrocracking zone and a catalytic hydrogenation zone. The process is improved by venting gases from the high temperature hydrocracking zone.

14 Claims, 1 Drawing Figure

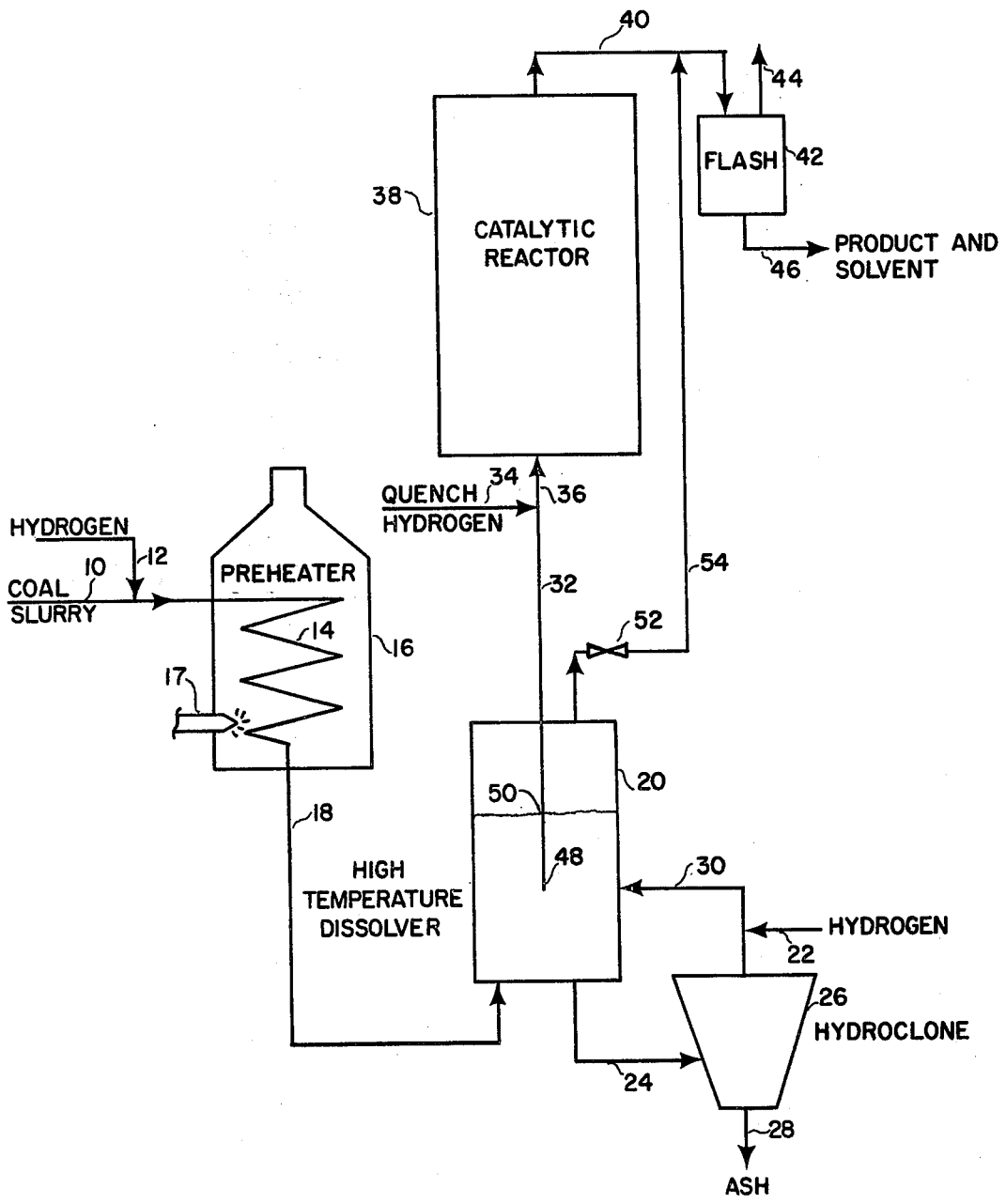
40
44
FLASH
42
38
CATALYTIC REACTOR
PRODUCT AND SOLVENT
46
QUENCH HYDROGEN
34
36
HYDROGEN
12
10
COAL SLURRY
PREHEATER
14
16
17
32
54
52
20
50
48
18
HIGH TEMPERATURE DISSOLVER
30
HYDROGEN
22
26
HYDROCLONE
24
28
ASH

PROCESS FOR LIQUEFYING COAL EMPLOYING A VENTED DISSOLVER

This invention relates to a process for converting ash-containing raw coal to deashed coal. More particularly, this invention relates to a process for converting ash-containing raw coal to deashed coal liquids in preference to deashed coal solids.

The coal liquefaction process of the present invention utilizes a preheater zone, a dissolver zone and a catalyst zone in series. The preheater zone is a non-backmixed tubular zone which is supplied with a slurry of pulverized feed coal and solvent wherein the temperature of each increment or plug of slurry increases during flow through the preheater to a maximum at the preheater outlet. The preheater zone is followed by a dissolver zone operated under conditions tending to approach backmixing in order to maintain as uniform a temperature throughout as possible, which temperature is higher than the maximum temperature in the preheater zone. Gases are continuously vented from the dissolver zone while dissolver zone liquid is passed to a catalytic hydrogenation zone operated at a reduced severity as compared to the dissolver zone including a temperature which is lower than the temperature in the dissolver zone and/or a liquid residence time which is lower than the liquid residence time in the dissolver zone. The catalyst zone contains a hydrogenation catalyst comprising Group VI and Group VIII metals on a non-cracking support. Suitable hydrogenation catalysts include cobalt-molybdenum and nickel-cobalt-molybdenum on alumina. The temperature in the dissolver zone is at least about 10° F. (5.5° C.), generally, or at least about 50° or 100° F. (27.8° or 55.5° C.), preferably, higher than the maximum preheater temperature. The temperature in the catalyst zone can be lower than the temperature in the dissolver zone. For example, the temperature in the catalyst zone can be about 25° F. (13.9° C.), generally, or about 50° or 150° F. (27.8° or 83.3° C.), or more, lower than the dissolver temperature.

The preheater exit temperature is maintained within the range of about 710° to below 800° F. (377° to 427° C.), generally, or 750° to 790° F. (399° to 421° C.), preferably. During the preheating step, the viscosity of each increment of feed slurry initially increases, then decreases and would finally tend to increase again. However, a significant final increase in viscosity is avoided by terminating the preheating step within the temperature range of 710° to below 800° F. (377° to 427° C.). If the preheater temperature exceeds this range, a substantial increase in viscosity can occur caused by polymerization of the dissolved coal. Such polymerization should be avoided since its result is formation of a product comprising a relatively large quantity of low value solid deashed coal at the expense of more valuable liquid coal. These viscosity effects are described in U.S. Pat. No. 3,341,447 to Bull et al, which is hereby incorporated by reference.

A final increase in viscosity is avoided by passing the plug flow preheater effluent which is at a temperature above about 710° but below about 800° F. (377° but below about 427° C.) into a backmixed dissolver zone maintained at a uniform temperature which is higher than the maximum preheater temperature. The dissolver temperature is between about 750° and 900° F. (399° and 482° C.), generally, and between above about 800° and 900° F. (427° and 482° C.), preferably. The temperature hiatus between the preheater and dissolver stages can be the temperature range in which undesired coal polymerization would occur. At the elevated dissolver temperature, instead of the aforementioned coal polymerization and viscosity increase, there is a viscosity decrease due to a molecular weight reduction via hydrocracking reactions. We have found that in order for the hydrocracking reactions to proceed effectively in the dissolver, a process hydrogen pressure of at least 3,100 or, preferably, at least 3,500 psi (217 or 245 Kg/cm$^2$) is required. At lower process hydrogen pressures, the elevated dissolver temperatures of this invention in combination with the extended residence times indicated below were found to induce excessive coking and thereby encourage production of carbonaceous insolubles at the expense of coal liquids. Therefore, in the dissolver stage of this invention, the use of an elevated temperature within the range of about 750° to about 900° F. (399° to 482° C.) is accompanied by a process hydrogen pressure above about 3,100 or 3,500 psi (217 or 245 Kg/cm$^2$). There is generally little advantage in employing a hydrogen pressure above 5,000 psi (350 Kg/cm$^2$).

The residence time in the preheater zone is between about 2 and 20 minutes, generally, and is between about 3 and 10 minutes, preferably. The residence time in the dissolver zone is longer than in the preheater zone in order to provide adequate time for thermal hydrocracking reactions to occur and is between about 5 and 60 minutes, generally, or between about 10 and 45 minutes, preferably. The use of an external preheater avoids a preheating function in the dissolver zone and thereby tends to reduce the residence time in the dissolver zone, thereby reducing the amount of coking occurring in the dissolver zone. Hydrocracking and coking are concurrent reactions in the dissolver zone. Hydrocracking is the more rapid of the two reactions, and any unnecessary extension of dissolver residence time will relatively favor the slower coking reactions over the more rapid hydrocracking reactions.

The primary solvation reactions in the preheater occur between the solvent and the feed coal and are considered to be endothermic. In contrast, the hydrocracking reactions occurring in the dissolver zone are exothermic. Therefore, the preheater requires heat input for the solvation reactions and to heat the mass of feed material while the dissolver not only sustains its own heat requirements but can also produce excess heat which is available for transfer to the preheater. The temperature of the dissolver can be controlled, if desired, by injection of hot or cold hydrogen, or by means of a heating or cooling coil. By maintaining the indicated temperature differential between the preheater and dissolver stages the excess heat available at the dissolver is at a sufficiently elevated temperature level that it can advantageously supply at least a portion of the heat requirement of the preheater, providing a heat balanced system.

In the absence of a subsequent catalytic stage, the dissolver effluent would be reduced in pressure and passed to a distillation zone, preferably a vacuum distillation zone, to remove individual distillate fractions comprising product coal liquid, product deashed solid coal, recycle solvent and a bottoms fraction comprising ash and non-distillable hydrocarbonaceous residue. However, such a distillation step results in a considerable loss of carbonaceous material from the valuable product fractions in the form of solid deposits within the distillation column. The reason for this loss is that the dissolver effluent bottoms comprise mostly dissolved asphaltenes. The asphaltenes are not stabilized as they leave the dissolver and upon distillation some can revert to an insoluble, non-distillable material. However, such a reversion is avoided by passing the dissolver effluent at process hydrogen pressure through a catalytic hydrotreating stage. In accordance with the present invention, a considerable process improvement is achieved by continuously venting from the process most of the gases in the dissolver zone while passing normally liquid hydrocarbons from the dissolver zone to the catalyst zone.

Although the catalyst stage does not perform a coal dissolving function, it increases product yield by stabilizing asphaltenes as liquids that would otherwise separate as an insoluble solid such as coke and by partially saturating aromatics in the solvent boiling range to convert them to hydrogen donor materials for use as recycle solvent. The dissolver zone improves operation of the catalyst zone by exposing the feed stream to at least one condition which is more severe than prevails in the catalyst zone and which induces hydrocracking thereby tending to reduce the viscosity of the flowing stream so that in the catalyst zone there is an improvement in the rate of mass transfer of hydrogen to catalyst sites in order to reduce coking at the catalyst. The more severe cracking conditions in the dissolver zone can include either or both of a longer residence time and a higher temperature than prevails in the catalyst zone. If required, the dissolver effluent can be reduced in temperature before entering the catalyst zone so that the catalyst zone is maintained at non-coking temperatures in the range of about 700° to 825° F. (371° to 441° C.), generally, and preferably in the range of about 725° F. to 800° F. (385° to 427° C.), in order to inhibit catalyst coking and to extend catalyst life. If the catalyst zone were operated at the more severe conditions of the non-catalytic dissolver zone, the rate of mass transfer of hydrogen would be inadequate to control coke make because of the high hydrogenation-dhydrogenation reaction rates experienced in the presence of supported Group VI and Group VIII metal hydrogenation catalysts at temperatures above 700° F. (371° C.). On the other hand, temperatures in the hydrocracking range in the dissolver zone induce much less coking because in the absence of a catalyst reaction rates are sufficiently low that the hydrogen mass transfer rate in the system is ordinarily adequate to reasonably inhibit coking at moderate residence times. While we have found that coking is controllable in the non-catalytic dissolver zone at a temperature in the range from about 750° to 900° F. (399° to 482° C.), provided that the hydrogen pressure is within the range of this invention, we have found that without a preliminary hydrocracking zone coking is too excessive in a catalytic zone at these same temperatures and hydrogen pressures to achieve catalyst aging characteristics.

The 3,100+ psi (217 Kg/cm$^2$) hydrogen pressure of this invention is critical in the catalyst zone as well as in the dissolver zone. The reason for this criticality is that, as stated above, supported Group VI and Group VIII catalysts induce high hydrogenation and dehydrogenation reaction rates. At hydrogen pressures below 3,100 psi (217 Kg/cm$^2$), dehydrogenation reactions (coking) tend to become excessive. However, at hydrogen pressures of 3,100 psi (217 Kg/cm$^2$) or more, sufficient hydrogen is dissolved in the coal liquid in the vicinity of active catalyst sites to promote hydrogenation reactions in preference to dehydrogenation reactions. The 3,100 psi (217 Kg/cm$^2$) hydrogen pressure was found to represent a threshold pressure level for inhibiting excessive dehydrogenation reactions. For example, at a hydrogen pressure of 3,000 psi (210 Kg/cm$^2$) in the catalyst stage, coking was found to be sufficiently severe to limit the catalyst life cycle to only about 7 days. In contrast, by increasing the hydrogen pressure to 4,000 psi (280 Kg/cm$^2$), the catalyst life cycle was extended to several months. This hydrogen pressure in the catalyst zone is accompanied by a hydrogen circulation rate of 1,000 to 10,000, generally, and 2,000 to 8,000, preferably, standard cubic feet of hydrogen per barrel of oil (18 to 180 and 36 to 144 SCM/100L). The liquid space velocity in the catalyst zone can be 0.5 to 10 generally, or 2 to 6, preferably, weight units of oil per hour per weight unit of catalyst.

The encouragement of hydrogenation reactions in preference to dehydrogenation reactions in the catalyst zone further contributes to an increase of liquid product yield by providing a high yield of solvent boiling range hydrogen donor materials for recycle. Since it is hydrogen donor aromatics that accomplish solvation of feed coal, a plentiful supply of such material for recycle encourages coal solvation reactions in the preheater and dissolver zones, thereby reducing the amount of coal insolubles.

Since the catalytic production of a high yield of partially saturated aromatics is important, a measure of the effectiveness of the catalyst zone is the amount of hydrogen which is consumed in that zone. In order for sufficient hydrogenation to occur in the catalyst zone, the catalyst activity should be sufficient so that at least about 4,000 standard cubic feet of hydrogen (112 M$^3$) per ton (1,016 Kg) of raw feed coal is chemically consumed, generally, or so at least about 10,000 standard cubic feet of hydrogen (280 M$^3$) per ton (1,000 Kg) of raw feed coal is chemically consumed, preferably. At these levels of hydrogen consumption a substantial quantity of high quality hydrogen donor solvent will be produced for recycle, inducing a high yield of liquid product in the process. Such a high level of hydrogen consumption in the catalyst zone illustrates the limited capability of the non-catalytic dissolver stage for hydrogenation reactions. Furthermore, such a high level of hydrogen consumption in the catalyst zone indicates that coking deactivation of the catalyst is minimal and that the catalyst stage is not hydrogen mass transfer limited. If the system were hydrogen mass transfer limited, such as would occur if the liquid viscosity were too high or the hydrogen pressure too low, hydrogen would not reach catalyst sites at a sufficient rate to prevent dehydrogenation reactions, whereby excessive coking at catalyst sites would occur and hydrogen consumption would be low.

The above-indicated elevated levels of hydrogen consumption in the catalyst zone are possible because of the advantageous effect of the high severity dissolver zone upon the catalyst zone. In tests made without the high severity dissolver zone, the catalyst became so rapidly deactivated that these elevated levels of hydrogen consumption could be sustained for only one week after a fresh catalyst refill, instead of several months of active catalyst life obtained with the high severity dissolver of this invention.

Table 1 shows the results of tests performed to illustrates the advantageous effect of elevated dissolver temperatures, even without a subsequent catalyst zone. In these tests, a slurry of pulverized Big Horn coal and anthracene oil was passed through a tubular preheater zone in series with a dissolver zone. Some vertical sections of the dissolver zone were packed with inert solids enclosed by porous partitions as shown in U.S. Pat. No. 3,957,619 to Chun et al. No external catalyst was added to the dissolver zone. Heat was added to the preheater zone but the dissolver zone was operated adiabatically. No net heat was added between the preheater and dissolver zones. Elevated dissolver temperatures were achieved by exothermic dissolver hydrocracking reactions.

The Big Horn coal had the following analysis:

| Feed Coal (Moisture Free) | |
|---|---|
| Carbon, Wt. % | 70.86 |
| Hydrogen, Wt. % | 5.26 |
| Nitrogen, Wt. % | 1.26 |
| Oxygen, Wt. % | 19.00 |
| Sulfur, Wt. % | 0.56 |
| Metals, Wt. % | 3.06 |
| Ash, Wt. % | 6.51 |
| Sulfur, Wt. % | 0.32 |
| Oxygen, Wt. % | 3.13 |
| Metals, Wt. % | 3.06 |
| Moisture, Wt. % | 21.00 |

Following are the data obtained in the tests:

TABLE 1

| | | | |
|---|---|---|---|
| Run Time (days) | 3.88 | 5.00 | 11.38 |
| MAF* Coal In Slurry, Wt. % | 29.53 | 29.53 | 29.53 |
| MAF* Coal Rate, gm/hr | 1225.71 | 1101.42 | 1035.20 |
| Preheater Outlet Temp., ° F. (° C.) | 713(378) | 715(379) | 729(387) |
| Dissolver Temp., ° F. (° C.) | 750(399) | 775(413) | 800(427) |
| Total Pressure, psi (Kg/cm$^2$) | 4100(287) | 4100(287) | 4100(287) |
| $H_2$ pp, psi (Kg/cm$^2$) | 3785(265) | 3842(269) | 3828(268) |
| Unconverted Coal, Wt. % of MAF* Coal | 32.48 | 24.67 | 12.20 |
| Chemical $H_2$ Consumption decimeters$^3$/kg MAF* Coal | 341.96 | 468.42 | 749.10 |
| Conversions, Wt. % MAF* Coal | | | |
| Solvation | 67.52 | 75.36 | 87.80 |
| Hydrocracking (fraction of MAF* coal converted to product boiling below 415° C.) | 17.31 | 31.65 | 54.33 |
| Denitrogenation, Wt. % | 4.78 | 6.31 | 21.32 |
| Oxygen Removal, Wt. % | 42.98 | 47.89 | 51.53 |

*MAF means moisture-and ash-free

The data of Table 1 show that as the dissolver temperature was increased in steps from 750° to 775° and 800° F. (399° to 413° and 427° C.), so that the temperature differential between the preheater and dissolver was increased from 37° F. to 60° F. and 71° F. (20° to 33° and 39° C.), respectively, the amount of coal dissolved increased from 67.52 to 75.36 and 87.80 weight percent of MAF coal, respectively, while the fraction of MAF coal converted to product boiling below 415° C. (779° F.) increased from 17.31 to 31.65 and 54.33 weight percent of MAF coal, respectively. These results illustrate the substantial advantage in terms of both quantity and quality of product obtained by autogenously increasing the temperature differential between the preheater and the dissolver stages by means of exothermic dissolver hydrocracking reactions. Not only is the product quantity and quality advantageously increased as the dissolver temperature and the temperature differential between the stages are increased, but also the process advantageously can become increasingly self-sufficient in heat requirements by transferring the increasingly high level sensible heat autogenously generated at the dissolver to the preheater. One means of accomplishing this heat transfer is by cooling the dissolver effluent by heat exchange with the preheater feed stream. A noteworthy feature of the tests is that the increasing temperatures were achieved in the dissolver with no net addition of heat to the process between the preheater and dissolver zones.

The present invention which employs a catalyst zone downstream from the dissolver zone is illustrated by the data of Tests 1 through 5, presented in Table 2. Tests 1 through 5 all employed a catalyst zone. Test 1 was performed with only preheater and fixed bed catalyst stages, without any filtering or other solids-removal step between the stages and without any dissolver stage. Tests 2, 3 and 4 were performed with the dissolver stage, but without a dissolver vent, using a stream comprising 95 percent hydrogen as a quench between the dissolver and fixed bed catalyst stages, but without a solids-removal step in advance of the catalyst stage. Test 5 was performed with a dissolver stage which was vented to remove a gaseous stream containing 85 to 90 percent hydrogen. In all the tests, the preheater temperature was below 800° F. (427° C.), specifically 720° to 790° F. (382° to 421° C.), and the solvent used was vacuum tower overhead from previous coal liquefaction runs. In the catalyst stage, the catalyst was a nickel-cobalt-molybdenum on alumina hydrogenation catalyst packed in vertical zones having a porous partition communicating with alternate vertical zones free of catalyst.

TABLE 2

| | Test 1 | Test 2 | Test 3 | Test 4 | Test 5 |
|---|---|---|---|---|---|
| Preheater, ° C. (° F.) | — | 382(720) | — | 421(790) | 421(790) |
| Dissolver Temp., ° C. (° F.) | No dissolver | 456(853) | 456(853) | 482(900) | 483(902) |
| Reactor (Cat.), ° C. (° F.) | 388(730) | 388(730) | 412(775) | 387(729) | 389(730) |
| Reactor WHSV (kg MAFC*/hr/kg Cat.) | | 1.29 | 1.28 | 1.34 | 1.27 |
| Dissolver WHSV (kg A.R.C.**/hr/liter) | | 1.05 | 1.04 | 1.22 | 1.16 |
| Yields, Wt. % MAFC*: | | | | | |
| $H_2$ Consumption | −3.12 | −4.9 | −5.9 | −6.1 | −4.6 |
| $C_1$–$C_5$ | 1.13 | 11.8 | 13.9 | 18.8 | 14.0 |
| $C_6$–200° C. | 4.14 | 18.1 | 20.7 | 22.4 | 20.0 |
| 200–415° C. | | 9.1 | 16.2 | 4.1 | 10.8 |
| 415° C.+(° F.+) | 59.24 | 28.5 | 22.5 | 36.0 | 39.3 |
| Unconverted Coal | 29.73 | 14.5 | 10.8 | 5.7 | 6.4 |
| $H_2S$ | 0.23 | 0.5 | 0.3 | 0.3 | .2 |
| CO, $CO_2$ | 2.34 | 10.8 | 12.2 | 5.4 | 4.8 |
| $H_2O$ | 5.95 | 11.6 | 9.3 | 13.4 | 9.1 |
| Solvation | — | 85.5 | 89.2 | 94.3 | 93.6 |
| Conversion(fraction of MAFC* converted to material boiling | | | | | |

TABLE 2-continued

| | Test 1 | Test 2 | Test 3 | Test 4 | Test 5 |
|---|---|---|---|---|---|
| below 415° C. (779° F.) | 11.03 | 57.0 | 66.7 | 58.3 | 54.3 |
| Recycle Solvent (450–775° F. (232–412° C.) vacuum tower overhead); % of process requirement | — | — | 96.8 | 92.6 | 98.9 |

*Moisture-and ash-free coal
**As received coal

The data of Test 1 of Table 2 show that without a dissolver stage 29.73 percent of the coal exclusive of moisture and ash remained undissolved and only 11.03 percent was hydrocracked to product boiling below 415° C. (799° F.). Hydrogen consumption was only 3.12 weight percent, based on MAF coal.

The data of Tests 2, 3 and 4 of Table 2 show that the use of a dissolver increased the yields of $C_1$ to $C_5$ products and gasoline, while decreasing the amount of 415° C.+ (799° F.+) oil. Undissolved coal was decreased from 29.73 percent to 14.5 percent, or less. However, these improved yields resulted in increased hydrogen consumptions. Also, the yield of heavy oil was reduced so drastically that the process did not product its full recycle solvent requirement. Tests 2, 3 and 4 show that as the dissol ver temperature increased, the amount of unconverted coal decreased but at the expense of a considerable increase in hydrogen consumption.

The data of Test 5 of Table 2 were taken with a vented dissolver and with nearly the same dissolver stage temperature that was employed in Test 4. In both Tests 4 and 5 the rate of hydrogen flow to the preheater was 100 SCF/hr (2.8 $M^3$/hr), while in Test 5 as compared to Test 4 the rate of hydrogen flow to the dissolver was increased to between about 200 and 250 SCF/hr (5.6 and 7 $M^3$/hr) to make up for hydrogen loss due to venting. The vented dissolver reduced hydrogen consumption from 6.1 to 4.6 percent without any significant change in the amount of coal dissolved. Test 5 shows the use of a vented dissolver resulted in less light products, including $C_1$ to $C_5$ products and light gas oil, and in a higher yield of heavy oil. The higher yield of heavy oil advantageously increased recycle solvent yield from 92.6 to 98.9 percent of process requirements.

The vented gases in Test 5 comprise acidic materials, such as carbon monoxide and carbon dioxide. Acidic materials can induce hydrocracking with a hydrogenation catalyst. The reduced hydrogen consumption of Test 5 may be due to the removal of the acidic gases from the process via venting in advance of the catalyst stage. The vented stream included hydrocarbons having about a 450° F. (232° C.) EP and included about 75 to 90 percent of the dissolver content of carbon monoxide and carbon dioxide produced in the process as well as substantially all the water present in the feed coal. Because carbon monoxide is a catalyst poison, in order to protect the hydrogenation catalyst, if the stream flowing to the catalyst zone contains above 100 or 500 weight ppm of carbon monoxide, venting must reduce the carbon monoxide content below these levels. Removal of these materials and the substitution thereof with a quench stream comprising a higher concentration of hydrogen than the vented stream advantageously results in an enhanced hydrogen partial pressure in the catalyst stage.

Another advantage of the venting step may arise from the fact that the vented stream contains low boiling hydrocarbons. The low boiling hydrocarbons which are vented tend to be saturated compounds while the higher boiling non-vented hydrocarbons tend to be aromatics. Since the 1006° F. + (541° C.+) bottoms of a coal liquid are largely asphaltenes, and since asphaltenes require a highly aromatic medium for solubilization, the selective venting of saturated compounds tends to provide an asphaltene-compatible liquid, thereby inhibiting deposition of asphaltenes in the apparatus or on the catalyst in the subsequent stage. Table 3 shows the saturates, olefins, aromatics and resins content in weight percent in various distillate fractions of an Illinois coal liquid. To define the term resin in Table 3, it is noted that resins and asphaltenes are both contained in the residue of a n-propane extraction but of this residue, resins are soluble in n-pentane while asphaltenes are insoluble.

TABLE 3

| Boiling Range of Fraction, ° C. (° F.) | | Saturates | Olefins | Aromatics | Resins |
|---|---|---|---|---|---|
| OP-174 | (OP-345) | 68.0 | 5.5 | 26.5 | — |
| 174-203 | (345-397) | 32.0 | 2.5 | 65.5 | — |
| 203-229 | (397-444) | 20.0 | 1.5 | 78.5 | — |
| 229-247 | (444-477) | 5.5 | 1.0 | 93.5 | — |
| 247-263 | (477-506) | 3.0 | 1.0 | 96.0 | — |
| 324-341 | (615-646) | 2.5 | — | 90.9 | 6.6 |
| 341-350 | (646-662) | 4.0 | — | 85.0 | 10.7 |
| 350-364 | (662-687) | 5.0 | — | 83.0 | 12.0 |
| 364-374 | (687-705) | 4.9 | — | 85.1 | 10.0 |
| 374-391 | (705-736) | 5.8 | — | 82.7 | 11.5 |
| 391-411 | (736-772) | 9.4 | — | 75.5 | 14.2 |
| 411-490 | (772-914) | 9.2 | — | 68.8 | 21.0 |
| 490-541 | (914-1006) | 2.0 | — | 63.0 | 34.8 |
| 541+ | (1006+) | | NOTE | | |

NOTE - Bottoms Contained 0.1% Saturates + Aromatics, 0.3 % Resins, 60.6% Asphaltenes, and 38.9% Benzene Insolubles Table 3 shows a high level of asphaltenes in the bottoms of the system. It is apparent from Table 3, that the removal by venting of the relatively low boiling hydrocarbons in a coal liquid provides an increasingly aromatic solution of increasing capability for stabilizing or forming a single phase with the asphaltenes in the bottoms.

The dissolver residence time is sufficient for solids to settle out. By separately removing a supernatant liquid stream and a settled solids stream, there can be a controlled build-up of solids in the dissolver, if desired. The coal ash solids contain materials, such as FeS, which are hydrogenation catalysts and provide a beneficial effect in the process. The catalytic effect of coal ash solids in a dissolver zone is disclosed in U.S. Pat. No. 3,884,796 to Hinderliter et al, which is hereby incorporated by reference. Therefore, there can be a controlled catalytic hydrogenation effect in the dissolver zone even though no extraneous catalyst is added to the dissolver zone.

The build-up of catalytic solids in the dissolver zone can be adjusted by controlled removal of an ash-containing sludge from the bottom of the dissolver, below the dissolver liquid draw off line. This stream can comprise more than about 30 or even 50 weight percent of ash-containing solids. It can be passed directly to a gasifier for conversion of its hydrocarbonaceous content to carbon monoxide and hydrogen. If desired, it can first be passed through a hydroclone for partial recovery of deashed coal liquids for a recycle to the dissolver.

A process scheme of this invention is shown in the drawing. As shown in the drawing, a slurry of pulverized feed coal and recycle or make-up solvent in line 10 is mixed with hydrogen entering through line 12 and flows without backmixing through coil 14 in preheater furnace 16 for a residence time of 2 to 20 minutes. Furnace 16 is heated by means of a flame from oil burner nozzle 17. The temperature of the stream leaving peheater 16 through line 18 is between about 710° and 800° F. (377° and 427° C.). This stream flows into high temperature dissolver zone 20 which is maintained at a temperature between about 750° and 900° F. (399° and 482° C.). The residence time in dissolver 20 is between about 5 and 60 minutes. A slurry which is relatively rich in ash is removed from dissolver 20 by passage through line 24 to hydroclone 26 from which ash-containing solids are removed through line 28 and from which liquid is removed for recycle to the dissolver through line 30. If desired, the temperature in dissolver 20 can be controlled by injecting hot or cold hydrogen into line 30 through line 22. Hot dissolver effluent liquid at a temperature between about 750° and 900° F. (399° and 482° C.) flows through dip leg 48 and line 32 and is quenched or cooled by any suitable means, such as by injection of cold hydrogen entering through line 34. The independent removal of ash (line 28) and liquids (line 32) from the dissolver permits a relative accumulation of ash in the dissolver, if desired. An accumulation of ash is beneficial since the ash contains catalytic hydrogenation components, such as FeS. Cooled dissolver effluent at a temperature between about 700° and 800° F. (371° and 427° C.) flows through line 36 into catalytic reactor 38 containing fixed beds of hydrogenation catalyst. The hydrogenation catalyst comprises Group VI and Group VIII metals on a non-cracking support. The liquid leaving reactor 38 in line 40 contains partially saturated aromatic molecules and is passed through a flash chamber 42. A gas vent line 54 containing at least partially open valve 52 extends from the top of dissolver 20 to reactor effluent line 40. Hydrogen-containing gases are removed from the flash chamber through line 44 for purification, compression and recycle to line 12, while liquid in line 46 comprises both product for removal from the process and solvent for recycle to line 10.

As shown in the drawing, liquid is removed from dissolver 20 through dip leg 48 which extends below dissolver liquid level 50, but terminates above a solids settling zone in the bottom of the dissolver. During the elongated residence time in the dissolver, a relatively high-solids slurry which is removed through line 24 settles out from the relatively low-solids supernatant liquid which is removed through dip leg 48. Liquid level 50 can be raised or lowered by the relative opening of valve 52 in dissolver vent line 54. Dissolver vent line 54 discharges about 70 to 95 volume percent or more of the gaseous mixture of hydrogen and light hydrocarbons (including hydrocarbons boiling below about 450° F. (232° C.)) into reactor effluent stream 40. As indicated in the data presented above, the use of vent line 54 results in a considerable savings in hydrogen without any significant change in the amount of coal which is dissolved.

We claim:

1. A process for liquefying coal at a hydrogen pressure above about 3,100 psi comprising passing a feed coal-solvent slurry and hydrogen through a tubular preheater zone to increase the temperature of the slurry to a maximum temperature from about 710° to about 800° F., passing effluent slurry from said preheater zone and hydrogen to a dissolver zone maintained at a temperature at least 10° F. higher than the maximum temperature in the preheater zone and in the range between about 750° and 900° F., the residence time in the dissolver zone being longer than in the preheater zone, venting a gaseous stream comprising carbon oxide gas, hydrogen and low boiling hydrocarbons from said dissolver zone, separately removing a liquid stream from said dissolver zone, and passing said removed liquid stream without a distillation step and hydrogen through a catalytic hydrogenation zone maintained at a temperature in the range 700° to 825° F.

2. The process of claim 1 wherein the hydrogen pressure is above about 3,500 psi.

3. The process of claim 1 including the step of obtaining a catalytic hydrogenation zone effluent stream and separating a solvent boiling range fraction therefrom, and recycling said solvent boiling range fraction to said preheater zone.

4. The process of claim 1 wherein said dissolver zone liquid stream is quenched with hydrogen before being passed to said catalytic hydrogenation zone.

5. The process of claim 1 wherein at least 4,000 SCF of hydrogen per ton of said feed coal are chemically consumed in said catalytic hydrogenation zone.

6. The process of claim 1 wherein said vented gaseous stream comprises hydrocarbons boiling up to about 450° F.

7. The process of claim 1 wherein a relatively high ash-containing slurry is separately removed from said dissolver zone.

8. The process of claim 1 wherein the temperature in said dissolver zone is at least 50° F. higher than the temperature in said preheater zone.

9. The process of claim 1 wherein the temperature in said dissolver zone is at least 100° F. higher than the temperature in said preheater zone.

10. The process of claim 1 wherein the preheater zone residence time is 2 to 20 minutes.

11. The process of claim 1 wherein the dissolver zone residence time is 5 to 60 minutes.

12. The process of claim 1 wherein the temperature in the dissolver zone is from above 800° F. to 900° F.

13. The process of claim 1 wherein the temperature in the catalytic hydrogenation zone is lower than in the dissolver zone.

14. The process of claim 1 wherein the liquid residence time in the catalytic hydrogenation zone is lower than in the dissolver zone.

* * * * *